United States Patent [19]

Murphy et al.

[11] 4,375,970

[45] Mar. 8, 1983

[54] CONVERTING MACHINE GUM BOX

[75] Inventors: Joseph M. Murphy, Wilbraham; Frank P. Sulewski, Jr., Southwick, both of Mass.

[73] Assignee: Westvaco Corporation, New York, N.Y.

[21] Appl. No.: 193,908

[22] Filed: Oct. 6, 1980

[51] Int. Cl.[3] ..... B05C 1/08; B05C 11/10

[52] U.S. Cl. ..... 493/337; 118/259; 118/612; 493/266

[58] Field of Search ..... 493/337, 336, 331, 281, 493/280, 279, 278, 132, 131, 266, 150; 118/259, 258, 261, 602, 612

[56] References Cited

U.S. PATENT DOCUMENTS

| | | | |
|---|---|---|---|
| 571,527 | 11/1896 | Honiss et al. | 118/262 |
| 2,568,629 | 9/1951 | Heywood | 493/266 |
| 2,641,220 | 6/1953 | Weber et al. | 118/259 |
| 2,731,945 | 1/1956 | Schaefer | 118/246 |
| 3,339,485 | 9/1967 | Rytterholm | 101/363 |
| 3,511,693 | 5/1970 | Davidson | 118/602 X |
| 4,300,476 | 11/1981 | Jurascheck et al. | 118/259 X |

*Primary Examiner*—James F. Coan

*Attorney, Agent, or Firm*—W. A. Marcontell; R. L. Schmalz

[57] ABSTRACT

A rotary converting machine gum box is replenished with adhesive by means of a pumped circulation system with a delivery conduit at one end of the gum box and a withdrawal conduit at the other end. Between the two gum box ends is provided a rotatively driven screw shaft to mechanically induce uniformly distributed adhesive flow from said one end to the other.

2 Claims, 2 Drawing Figures

CONVERTING MACHINE GUM BOX

BACKGROUND OF THE INVENTION

1. Field of the Invention

The present invention relates to paper or sheet product converting machines of the rotary type wherein a serial multiplicity of cutting, scoring, folding and gluing operations are performed on sheet material such as paper drawn from a reel of indefinite length to produce a finished product.

More particularly, the subject invention relates to an improvement in gum box apparatus used as a subcombination element in a rotary converting machine.

2. Description of the Prior Art

The generally practiced prior art technique of applying gum adhesive to precisely designated areas of a paper sheet product blank in transit through a rotary converting machine is to print the gum onto the blank by a rotary image transfer means called a picker as the blank passes between the picker carrying roll and a backing roll. U.S. Pat. No. 2,568,629 to V. E. Heywood is representative of the prior art as presently practiced with a rotary envelope machine.

Relative to the Heywood disclosure, gum adhesive is applied to the picker print face from the surface of a rotating metering roll in the same manner as practiced by the rotogravure arts. A portion of the rotating meter roll periphery is immersed in a viscous, fluidized gum bath. A doctor blade skims the film adhering to the meter roll surface to leave a thinner film of gum having a precisely graduated thickness remaining on the roll surface. Continued rotation of the meter roll past the doctor blade brings the doctored gum film into contact with the print face of the picker which, by viscous fluid adhesion, picks that portion of the film off the meter roll surface onto the picker print face.

As the picker roll continues rotation past tangency with the meter roll and into tangency with a backing roll, a register aligned envelope blank is drawn into the nip between the picker and backing roll where gum on the picker print face transfers to the envelope surface at the desired location.

At the current state of art development, envelope machines such as Haywood's are capable of producing up to 72,000 envelopes per hour and consume 0.5 gallon per hour of adhesive from a single gum box in the process. Such a fluid consumption rate would normally suggest the utility of an automatically controlled, pumped supply of adhesive to the gum box.

Although the concept of pumped gum box replenishment, may, under the circumstances, appear obvious, as a practical fact this has not occurred. Gum boxes on high speed rotary converting machines such as Heywood's are predominantly replenished from small, one liter sized, manually changed vessels which dispense their contents by means of a simple, vacuum regulated liquid level control apparatus.

The operative reasons for continued use of such an archiac gum supply system reside in the physical characteristics of the gum and its rheology. For example, the gum solids are dissolved in a highly volatile solvent to permit rapid drying after application to the envelope blank. However, the gum pond through which the meter roll rotates is atmospherically open thereby permitting solvent loss to the atmosphere prior to application on the envelope. The aforedescribed small gum containers represent an effort to minimize the surface area of fluid gum exposed by the gum pond. Although it is desirable to minimize the pond size, the absolute scale required for manual manipulation of a gum supply container necessitates an undesirably large pond.

As a consequence of the gum rheology, the continuous shear of the meter roll surface through the pond tends to upset and thicken the gum viscosity. The adhesive meter roll has a 1:1 rotational ratio with the article production rate; e.g. an envelope production rate of 1200 envelopes per minute requires 1200 meter roll revolutions per minute. Simultaneously, the adhesive viscosity may, representatively, be in the order of 3000 centipoises at 70° F. The meter roll surface draws the thick adhesive fluid to a shear line at the doctor blade which allows a small portion of the adhesive propelled by the roll surface to pass through the blade gap opening. The remaining portion of the moving fluid inertially drives across the pond bottom to be cyclically returned to the meter roll surface. Resultantly, the adhesive pond is, dynamically, in a continuous, rolling circulation and boundary layer shearing. It is the high frequency shearing of the adhesive that upsets the physical rheology of the substance to further increase the viscosity. Consequently, within the rolling circulation of the adhesive pond, flow channels are developed between a single, centrally located, adhesive supply point and the meter roll surface. Such flow channels are bounded by flow stagnation zones wherein the gum eventually gels. The gelatinization is progressive and finally obstructs all flow regions between the source container and the meter roll surface. When this occurs, the machine production must be interrupted while the gum box is purged of gelatinized gum and thoroughly cleaned.

This latter consequence of gum distribution to the meter roll surface occurs regardless of the gum supply technique; whether by bottle or by pumped replenishment. Since the machine downtime for gum box cleaning represents the major value of operating maintenance losses, there has been little incentive to replace the bottle gum supply system with a pumped system.

It is, therefore, an object of the present invention to teach a rotary converting machine gum box system having mechanical gum distribution means between a gum supply point and the respective meter roll surface.

Another object of the present invention is to provide a rotary converting machine gum box with a rapidly circulating pumped replenishment system requiring minimal atmospherically exposed area and infrequent maintenance cleaning.

SUMMARY OF THE INVENTION

These and other objects of the invention are accomplished by means of a pumped gum supply system wherein gum fluid is discharged into the gum box at one end of a rotatively driven screw shaft spanning the gum box width parallel to the meter roll axis. At the opposite end of the screw, gum flow in excess of consumption is driven by the screw shaft into a removal conduit.

Between the two ends of the screw prevails open communication between the screw helix edge and the meter roll surface.

Although the screw is not disposed for positive displacement flow between the inlet and outlet gum circulation ports, migration of such flow is mechanically induced sufficiently to prevent stagnation.

BRIEF DESCRIPTION OF THE DRAWING

Relative to the drawing wherein like reference characters designate like or similar elements throughout the two figures.

DESCRIPTION OF THE PREFERRED EMBODIMENT

Figure 1:
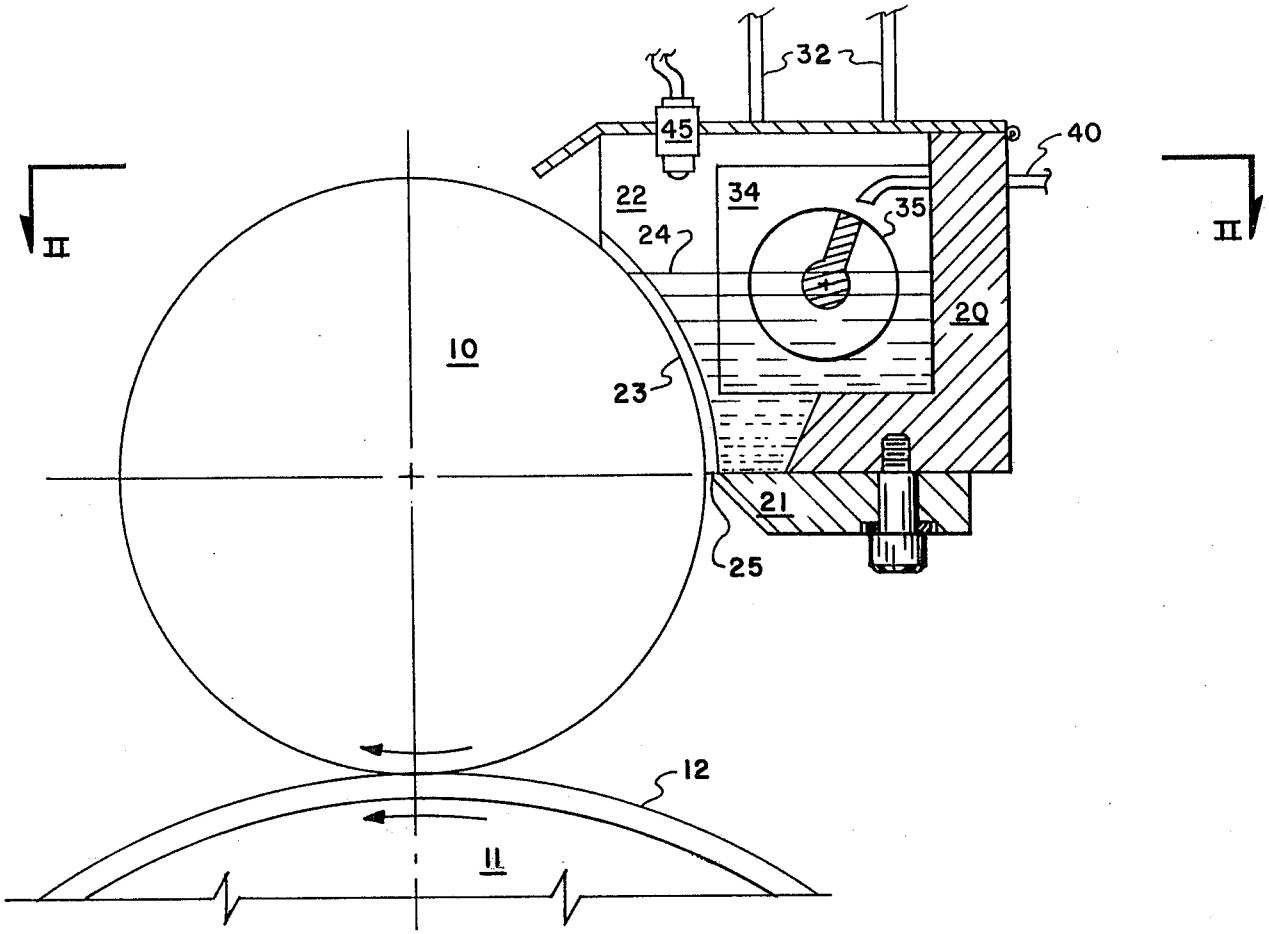
FIG. 1 is a sectional end elevation of a gum box apparatus constructed pursuant to the present invention; and, FIG. 2 is a sectional plan of a gum box apparatus constructed pursuant to the present invention.

Relative to the drawing, a rotary converting machine to which the invention relates, such as an envelope machine, comprises an adhesive (gum) metering roll 10 rotatively driven in nip coordination with a picker roll 11 at rotational speeds in the order of 1200 rpm. An image transfer element 12 secured to the picker roll surface is carried into nip proximity with a thin film of adhesive coating the meter roll surface. Said meter roll film transfers to the image element 12 upon rolling contact therewith. Continued rotation of the picker roll subsequently takes the image element 12 into registered contact with a sheet product blank thereby "printing" the adhesive thereon in the exact position and configuration desired.

The thin adhesive film on the meter roll surface is developed by means of a gum box device which basically comprises an L-shaped back and bottom frame 20 having side panels 22. An adjustably positioned doctor blade 21 completes the gum box bottom structure to confine a gum pond 24. Sealing shoes 23 secured to the side panels 22 seal the liquid adhesive pond 24 relative to the curved, rotating surface of the meter roll 10.

As the surface of the rotatively driven meter roll 10 rolls into immersion with the standing pond of adhesive 24, it is flood coated with the substance having a viscosity in the range of 1000 to 8000 centipoises at 72° F. A discrete gap setting between the doctor blade 21 wiping edge and the meter roll surface permits only a desired thickness of film to remain on the roll surface.

Figure 2:
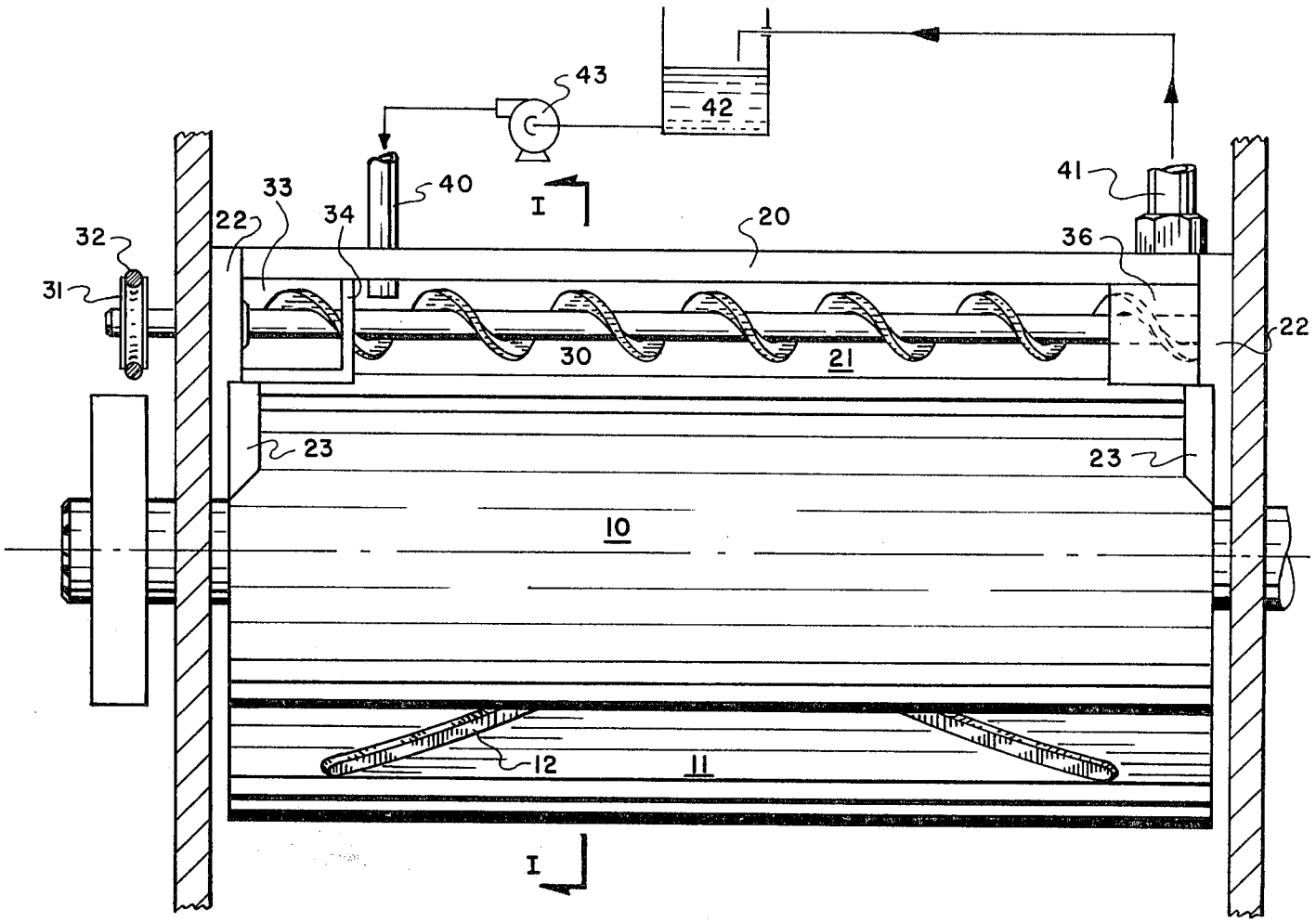

In lieu of a batch quantity of adhesive provided by a bottle-vacuum flow regulation device, the present invention utilizes a reservoir vessel 42 (FIG. 2) removed from the machine structure. Adhesive is drawn from the reservoir 42 by a pump 43 and delivered into the gum box enclosure by a conduit 40. From the plan of FIG. 2, it will be noted that the supply and return conduits 40 and 41, respectively, are positioned at opposite ends of the gum box length.

Between the gum box ends 24 spans a rotatively driven helix element screw shaft 30 which may be driven by means of a belt 32 and sheave 31 arrangement.

At the powered end of the screw shaft 30, which passes through the respective gum box end 22 thereby requiring bearings, is provided a seal chamber 33 defined by a chamber wall 34 penetrated by an aperture 35 of approximately the same diameter as the major diameter of the screw 30 helix. Rotation of the screw shaft 30 continuously purges the seal chamber 33 of adhesive thereby protecting the bearings from adhesive penetration.

The major helix diameter of the screw shaft 30 is enclosed at the idling end thereof by a housing 36 which is drained by the discharge conduit 41. Cooperatively, extension of the screw shaft helix element into the housing 36 enclosure functions as a helical pump to positively discharge the adhesive as a fluid traverse between the gum box ends is completed.

Between the two screw ends, the constantly rotating screw shaft 30 induces a mechanical bias to keep all segments of the total adhesive volume within the gum box moving thereby preventing stagnation zones by limiting the number of shear events between the meter roll surface and the doctor blade to which the total volume will be subjected.

Since the adhesive consumption rate will vary in proportion to the machine production rate, an independent level control is desirable. In the present invention, a coaxial reflective optical proximity sensor 45 is used to good advantage to control the pump 43 delivery, whether by direct control over the pump or by control of a delivery valve not shown. In a most simplified form, no attempt is made to regulate the pump delivery volume by the optical level sensor except in a complete on or off mode. If the pond level rises too high, the supply pump 43 delivery is completely interrupted.

Having fully disclosed my invention, numerous mechanical equivalents to the specific elements of my preferred embodiment will readily occur to those of ordinary skill in the art. For example, other forms of mechanical flow inducement within the gum box may take the form of endless driven belt or chain circuit having paddles, scrapers or brackets attached thereto.

As our invention, however,

We claim:

1. A rotary converting machine gum box comprising back, opposite end and bottom wall portions disposed longitudinally adjacent an adhesive metering roll, said bottom wall portion also including a doctor blade for the surface of said metering roll, said wall portions and metering roll surface defining a fluid adhesive pond enclosure, the improvement comprising:

A. An adhesive circulation system including first pump means for delivery of adhesive to one end of said pond enclosure from an atmospherically enclosed reservoir vessel and second pump means to induce withdrawal of adhesive from the other end of said pond enclosure to said reservoir vessel;

B. A rotatively driven screw shaft positioned between said gum box ends axially parallel with said metering roll, said screw shaft having a major diameter helix element with a lead advancing from said one wall end to said other wall end to positively induce adhesive flow within said gum box from one end to the other in flooding contact with said metering roll surface; and, C. Sealing wall means defining a seal chamber for isolating a screw shaft penetration region of said one end wall from said pond enclosure, said sealing wall having an aperture therein approximately the same as said major helix diameter to receive said screw shaft therethrough whereby rotation of said screw shaft purges adhesive from said shaft penetration region of said one end wall.

2. A gum box as described by claim 1 wherein said second pump means comprises a housing for said major diameter helix element portion of said screw shaft at said one gum box end and a conduit opening within said housing to receive adhesive drawn into said housing by said screw shaft rotation.

* * * * *